US011489249B2

(12) United States Patent
Sautter et al.

(10) Patent No.: US 11,489,249 B2
(45) Date of Patent: Nov. 1, 2022

(54) VEHICULAR COMMUNICATION SYSTEM

(71) Applicant: Hirschmann Car Communication GmbH, Neckartenzlingen (DE)

(72) Inventors: Wolfgang Sautter, Reutlingen (DE); Thomas Adam, Bad Urach (DE); Dominik Schaich, Neckarhausen (DE); Tobias Pfaeffle, Stuttgart (DE); Uwe Daum, Filderstadt (DE); Christian Schwarz, Metzingen (DE); Markus Pfletschinger, Eningen (DE); Uwe Kreissig, Eschenbach (DE)

(73) Assignee: HIRSCHMANN CAR COMMUNICATION GMBH, Neckartenzlingen (DE)

( * ) Notice: Subject to any disclaimer, the term of this patent is extended or adjusted under 35 U.S.C. 154(b) by 346 days.

(21) Appl. No.: 16/307,957

(22) PCT Filed: May 11, 2017

(86) PCT No.: PCT/EP2017/061295
§ 371 (c)(1),
(2) Date: Dec. 28, 2018

(87) PCT Pub. No.: WO2017/211534
PCT Pub. Date: Dec. 14, 2017

(65) Prior Publication Data

US 2019/0312342 A1 Oct. 10, 2019

(30) Foreign Application Priority Data

Jun. 9, 2016 (DE) ..... 102016210170.6
Sep. 30, 2016 (DE) ..... 102016118629.5

(51) Int. Cl.
*H01Q 1/22* (2006.01)
*H01Q 1/32* (2006.01)
(Continued)

(52) U.S. Cl.
CPC ..... *H01Q 1/3275* (2013.01); *H01Q 1/02* (2013.01); *H01Q 1/1207* (2013.01)

(58) Field of Classification Search
CPC ..... H01Q 1/3275; H01Q 1/02; H01Q 1/1207; H01Q 1/22; H04B 1/3822
See application file for complete search history.

(56) References Cited

U.S. PATENT DOCUMENTS 8,319,693 B2 11/2012 Chakam
8,614,645 B2 12/2013 Chakam
(Continued)

FOREIGN PATENT DOCUMENTS

CN 200820134116.4 Y 8/2009
CN 102395226 A 3/2012
(Continued)

*Primary Examiner* — Dimary S Lopez Cruz
*Assistant Examiner* — Bamidele A Jegede
(74) *Attorney, Agent, or Firm* — Andrew Wilford

(57) ABSTRACT

The invention relates to a communication system (1), comprising at least one housing (2) having a first and an additional housing part (201, 202). In the housing (2), a circuit board (10) having electronic components (11) is arranged, and outside the housing (2), at least one antenna element is arranged. The invention is characterized in that an antenna support (7) that is connectable to the housing (2) is provided, wherein the at least one antenna element (14) is arranged on the surface and/or inside the antenna support (7).

14 Claims, 4 Drawing Sheets

(51) Int. Cl.
*H01Q 1/12* (2006.01)
*H01Q 1/02* (2006.01)

(56) References Cited

U.S. PATENT DOCUMENTS 9,437,513 B2 9/2016 Fuergut et al.
9,793,602 B2 10/2017 Aminzadeh
9,966,659 B2 5/2018 Chakam
10,283,853 B2 5/2019 Gerneth et al.
2003/0117776 A1* 6/2003 Katsuro ..... H05K 7/20854 361/705
2003/0231140 A1* 12/2003 Haussler ..... H01Q 1/3275 343/888
2004/0235317 A1* 11/2004 Schiefer ..... H05K 9/0037 439/76.2
2005/0059444 A1* 3/2005 Martinez ..... H01Q 1/362 455/575.7
2006/0038726 A1* 2/2006 Iacovella ..... H01Q 1/521 343/713
2006/0072288 A1* 4/2006 Stewart ..... H02K 1/148 361/690
2006/0244667 A1* 11/2006 Thompson ..... H01Q 1/3275 343/713
2007/0013593 A1* 1/2007 Zafar ..... H01Q 21/28 343/700 MS
2007/0040757 A1* 2/2007 Blickle ..... H01Q 1/1214 343/713
2007/0241971 A1* 10/2007 Tsujimura ..... H01Q 9/16 343/702
2007/0279304 A1* 12/2007 Chakam ..... H01Q 1/088 343/713
2007/0296638 A1* 12/2007 Kim ..... H01Q 1/52 343/702
2008/0111752 A1* 5/2008 Lindackers ..... H01Q 21/28 343/713
2008/0129620 A1* 6/2008 Zurowski ..... H01Q 1/1214 343/713
2008/0198077 A1* 8/2008 Duzdar ..... H01Q 21/30 343/715
2008/0316120 A1* 12/2008 Hirota ..... H01Q 9/42 343/702
2008/0318447 A1* 12/2008 Tomioka ..... H01Q 1/2258 439/76.1
2009/0058737 A1* 3/2009 Tsujimura ..... H01Q 1/243 343/702
2009/0066593 A1* 3/2009 Jared ..... H01Q 1/3275 343/713
2009/0201216 A1* 8/2009 Gerneth ..... H01Q 1/42 343/872
2009/0207084 A1* 8/2009 Ikeda ..... H01Q 5/40 343/713
2010/0013724 A1* 1/2010 Ohshima ..... H01Q 1/3275 343/713
2010/0100156 A1 4/2010 Crivelli et al.
2010/0231458 A1* 9/2010 Koyama ..... H01Q 21/28 343/702
2010/0231467 A1* 9/2010 Schnuerer ..... H01Q 1/3275 343/713
2010/0277379 A1* 11/2010 Lindackers ..... H01Q 1/3275 343/713
2010/0302125 A1* 12/2010 Chang ..... H01Q 1/3275 343/872
2010/0315301 A1* 12/2010 Marten ..... H01Q 1/42 174/59
2011/0279329 A1* 11/2011 Kleinert ..... H01Q 1/1214 343/702
2012/0212912 A1* 8/2012 Tanaka ..... H01Q 1/52 361/749
2012/0243463 A1* 9/2012 Aguirre ..... H01Q 1/246 370/316
2012/0274519 A1* 11/2012 Chakam ..... H01Q 9/0407 343/702
2013/0113665 A1* 5/2013 Burg ..... H01Q 1/3275 343/713
2013/0249748 A1* 9/2013 Togura ..... H01Q 9/26 343/713
2013/0335276 A1* 12/2013 Lee ..... H01Q 1/243 343/702
2013/0342405 A1* 12/2013 Ueno ..... H01Q 1/32 343/713
2014/0028507 A1* 1/2014 Mierke ..... H01Q 1/1214 343/713
2014/0085152 A1* 3/2014 Klemmensen ..... H01Q 9/0407 343/702
2014/0125543 A1* 5/2014 Chen ..... H01Q 1/3275 343/841
2014/0228080 A1* 8/2014 Choi ..... H04M 1/0283 455/575.1
2014/0292593 A1* 10/2014 Thiam ..... H01Q 9/0421 343/713
2015/0042528 A1* 2/2015 Jung ..... H01Q 1/526 343/787
2015/0071137 A1* 3/2015 Thiam ..... H04B 7/0413 370/297
2015/0102479 A1 4/2015 Fuergut et al.
2015/0123854 A1* 5/2015 Chakam ..... H01Q 1/1214 343/702
2015/0188226 A1* 7/2015 Ng ..... H01Q 9/42 343/862
2015/0270603 A1* 9/2015 Lee ..... H04B 1/18 343/713
2015/0288053 A1* 10/2015 Saxe ..... H01Q 1/40 343/702
2015/0307026 A1* 10/2015 Minikey, Jr. ..... A61B 8/085 348/148
2015/0351195 A1* 12/2015 Sargent ..... F21V 21/30 315/158
2015/0357714 A1* 12/2015 Ng ..... H01Q 1/3275 343/848
2016/0070001 A1* 3/2016 Krantz ..... G01S 19/32 342/357.72
2016/0104932 A1* 4/2016 Aminzadeh ..... H01Q 5/40 343/872
2016/0118719 A1* 4/2016 Shirley ..... H01Q 23/00 343/700 MS
2016/0172746 A1* 6/2016 Butscher ..... H01Q 1/3275 343/713
2016/0223263 A1* 8/2016 Emrich ..... F28F 9/0219
2016/0372399 A1 12/2016 Fuergut et al.
2017/0229768 A1* 8/2017 Gerneth ..... H01Q 1/12
2019/0312342 A1 10/2019 Sautter et al.

FOREIGN PATENT DOCUMENTS

EP 2849350 A1 3/2015
FR 3443614 B1 * 4/2016 ..... H01Q 1/02
JP 4754284 B2 * 8/2011 ..... B60R 11/04
WO 2009/047122 A1 4/2009

* cited by examiner

VEHICULAR COMMUNICATION SYSTEM

CROSS REFERENCE TO RELATED APPLICATIONS

This application is the US-national stage of PCT application PCT/EP2017/061295 filed 11 May 2017 and claiming the priority of German patent application 102016210170.6 itself filed 9 Jun. 2016 and German patent application 102016118629.5 itself filed 30 Sep. 2016.

FIELD OF THE INVENTION

The invention relates to a communication system that comprises at least one housing that has a first and a second housing part, with a circuit board with electronic components being in the housing and with at least one antenna element being outside the housing, according to the features of the respective preamble of the independent claims.

BACKGROUND OF THE INVENTION

An antenna module is known from DE 10 2012 208 303 [U.S. Pat. No. 9,966,659] that is embodied in a single piece and has at least one outside receiving and/or transmitting antenna element under an outer cover, and comprises an antenna box that has no or a few inside internal antennas and encloses electronic circuits that work with the antenna elements. The outer cover is releasably fixed to the antenna box, the outer cover can be mounted so as to project out of the vehicle roof through an opening in a vehicle roof, and the antenna box is closed on all sides and can be mounted beneath the vehicle roof with a metallic top side. The metallic top side of the antenna box has feedthrough holes to the outside antenna elements, and the outside antenna elements in the outer cover are electrically are coupled via the feedthroughs with the circuits within the antenna box that is closed on all sides.

However, such an antenna module has the disadvantage, for one, that the antenna elements are beneath the outer cover, so the size of the outer cover depends on the size of the largest antenna element, meaning that space is disadvantageously wasted if a plurality of antenna elements of different sizes have to be accommodated beneath the outer cover.

For another, there is the disadvantage that the antenna box, which is closed on all sides, is in contact with the surface toward the lower face of the vehicle roof, so that solar radiation acting on the vehicle roof, which is a good conductor of heat, is routed via the metallic upper side directly into the interior of the antenna box. This results in extreme heating of the interior of the antenna box, which is compounded by the fact that the antenna box is closed on all sides. On the one hand, the heat introduced from outside via the vehicle roof into the antenna box, which is closed on all sides, and possibly also from the interior of the vehicle into the antenna box cannot be dissipated and, on the other hand, leads to a loss of power on the part of the electronic circuits that are inside the antenna box. In extreme cases, exceeding the maximum permissible temperatures may even result in a total failure of the known antenna module. This is disadvantageous, particularly when emergency call functions ("e-calls" for example) are implemented via this antenna module.

OBJECT OF THE INVENTION

It is therefore the object of the invention to improve a communication system of this described type and to avoid the disadvantages discussed above. In particular, the resilience of the communication system at high ambient temperatures is to be increased, thereby enhancing the performance of the communication system.

SUMMARY OF THE INVENTION

This object is achieved by the features of the independent claims.

An antenna support that can be connected to the housing is provided according to the invention with the at least one antenna element on the surface and/or within the antenna support. By virtue of this arrangement of the at least one antenna element on the surface of the antenna support, an especially compact design is achieved, since the at least one antenna element is also configured so as to be flat and can be mounted above the surface of the vehicle body. In addition, by virtue of the antenna support and the at least one antenna element being on the surface of the antenna support, airflow and/or heat radiation as well as heat conduction through these surfaces can be utilized to dissipate heat. Moreover, the performance of the communication system, in particular its electronics, can no longer be substantially affected by radiated heat from the outside, since it is no longer beneath an outer cover (like in the prior art described above). The antenna support is thus a three-dimensional structure that carries the at least one antenna element on its outer and/or inner surface. If the at least one antenna element is inside the antenna support, this means that the at least one antenna element is surrounded by the material that forms the antenna support. Consideration is given here to the fact that the antenna support is cast or injection-molded from an electrically nonconductive material (such as plastic), and the at least one antenna element that is made of an electrically conductive material (such as wire, wire mesh, lead frame, electrically conductive foil, electrically nonconductive support film with conductor structures or the like on it) is surrounded at least partially, preferably completely by the electrically nonconductive material during (injection) molding. That is, the electrically conductive materials can also be partially exposed on the surface of the antenna support.

Alternatively or in addition to the antenna support described above, a functional element support that can be connected to the housing and has thermal conductivity properties is provided. On the one hand, this functional element support has thermal conductivity properties that can dissipate heat from the housing into surrounding cooler regions by conduction. On the other hand, other elements (such as electronic components and circuits, but also antenna elements as an alternative or in addition, particularly a rod antenna, a GPS patch, or the like) can be on and attached to it. The functional element support is thus a three-dimensional structure having at least one thermally conductive element (such as aluminum or copper foil) on its outer and/or inner surface. If the at least one thermally conductive element is inside the functional element support, this means that the at least one thermally conductive element is surrounded by the material that forms the functional element support. Consideration is also given here to the fact that the functional element support is cast or injection-molded from an electrically nonconductive material (such as plastic), and the at least one thermally conductive element, which is made of an electrically conductive material (such as wire, wire mesh, lead frame, electrically conductive foil, or the like), is surrounded at least partially, preferably completely by the electrically nonconductive material during (injection) molding. That is, the thermally conductive materials can also be partially exposed on the surface of the antenna support. The functional element support itself can also be made of a conductive material.

This functional element support with thermal conductivity properties thus advantageously dissipates heat from the interior of the housing into cooler regions. If the communication system is embodied as a roof antenna arrangement, the heat conduction thus occurs into the cooler areas of the roof antenna, particularly upward toward the decorative cover that is on the roof of the vehicle and is visible from the outside and exposed to sunlight. While it has heretofore been assumed that heat accumulation will occur beneath the decorative cover (due to solar radiation), it has been surprisingly found that this area is cooler than the interior of the housing, which means that heat can (also) be dissipated from there toward the interior of the decorative cover (or the outer cover).

While the antenna supports and functional element supports described hitherto are independent components, their design and function can also be combined in a particularly advantageous manner in a single component. Such a support as described above thus has the at least one antenna element and the at least one thermally conductive element that can be designed and arranged as described above. It is very especially advantageous if an antenna and a heat-conductive element are combined into a single element. This is the case, for example, when an electrically conductive foil (copper, aluminum, and the like) is used that has both thermal conductivity properties and high-frequency properties. Preferably, antenna elements (foil elements) made of copper that are connected, particularly soldered to a circuit board inside the housing enable the heat to be conducted into the cooler region from below the vehicle body surface (particularly of the vehicle roof) upward to the cooler region outside the vehicle.

In a development of the invention, one housing part has at least one heat sink with high thermal conductivity. This at least one heat sink is at a suitable location in the housing or housing part in order to dissipate heat in general or heat that is produced by an electronic component within the housing, for example, from the interior of the housing to the outside. To this end, the housing part in which the at least one heat sink is provided (preferably the housing part that is arranged toward a passenger compartment of the vehicle) is made of a thermally conductive material, such as a thermally conductive metal or preferably of a thermally conductive plastic. Heat that is present at a specific location within the housing is thus dissipated in a targeted manner via the at least one heat sink from the interior of the housing to the outside. It is here that the effect of heat conduction is applied. It is therefore essential that the heat source be in direct contact with the heat sink over a maximally large surface. This advantageously reduces the internal temperature in the housing, so that electronic components cannot be damaged or destroyed by inadmissibly high temperatures or operated at higher temperatures. The housing part with the at least one heat sink can be the one that faces toward the vehicle body surface (and then referred to as the upper part, for example) and/or that faces away from the vehicle body surface (facing for example toward the passenger compartment) (and then referred to as for example the lower part).

In a development of the invention, the at least one heat sink is formed by the housing part itself and/or by a separate component that is on and fixed to the housing part in the appropriate location. If the heat sink is formed by the housing part, the manufacture of the housing part in an appropriate shape can be considered. It is for example also possible for the heat sink to be provided with a material having high thermal conductivity. In a preferred embodiment, the housing part is made of a thermally conductive plastic that is shaped for example appropriately in a plastic injection molding process in order to produce the at least one heat sink that is then also provided with a separate component or provided with a coating. This separate component or the coating is advantageously made of a metal with high thermal conductivity. If the second component that is located in the vicinity of the heat sink of the housing part is made of metal, it is aluminum. If it is a coating, anodization can be considered in the case of an aluminum alloy.

If the heat sink is a separate component, the housing can be provided with an opening into which the heat sink, which is made of suitable material, is inserted. One example of a suitable material with an appropriate geometric shape is an aluminum sheet (blank or anodized).

Normally, the communication system described above is installed through an opening in a body part (particularly the vehicle roof). In that case, the housing is beneath the roof, whereas the antenna support projects beyond the surface of the vehicle roof to the outside. It should already be noted at this juncture that the face of the body part facing toward the face of the housing is at a considerable spacing. This effectively prevents heat input from the outside onto the roof, particularly solar radiation, from being transmitted via the body part into the interior of the housing by heat conduction. Just the layer of air between the surface of the housing and the lower face of the body part of the vehicle is already sufficient for effective insulation that contributes to a reduction of the internal temperature in the housing. How this occurs will be explained below.

With its at least one antenna element on its surface, the antenna support projects beyond the upper face of the body part. This region is thus exposed to the external environmental influences of the vehicle. In order to effectively protect the surface of the antenna support with at least one antenna element thereon against these external environmental influences such as air flow, water, mechanical stresses, and the like, consideration can be given to providing a coating on the surface of the antenna support and the at least one antenna element thereon. Alternatively or in addition, in another embodiment of the invention the antenna support can be connected to a decorative cover. This decorative cover, which extends above the surface of the body part, can thus be mounted in an advantageous manner when the communication system with the housing and the antenna support thereon has already been mounted from the lower face of the body part through a recess in the body part. As a suitable connector between the decorative cover and the antenna support, locking means, adhesive connections, and the like, or even simply contact without a firm connection, can be considered. The reverse assembly sequence is also conceivable.

In a development of the invention, the antenna support has surfaces for thermal connection to the decorative cover and/or the housing. If the decorative cover is slipped over the antenna support in the final assembled state, the surfaces for thermal connection between the inside of the decorative cover and the outside the antenna support advantageously cause heat dissipation from the interior of the decorative cover and thus from the interior of the antenna support to the outer surface of the decorative cover. An air or heat flow along and/or transverse to the vertical axis of the vehicle advantageously brings about effective heat dissipation, with the heat transport from the interior of the communication system via the surfaces for thermal connection to the outside. This effect is then enhanced if the housing and the antenna support also have such surfaces for thermal connection, since heat can also be dissipated from the interior of the housing via the antenna support and the decorative cover.

The above-described surfaces for thermal connection can be considered as a standalone solution for dissipating heat from the interior of the housing and/or from the interior of the antenna support to the outside, particularly via the decorative cover. On the other hand, the heat sinks described above can also be considered as a standalone solution for dissipating heat from the interior of the housing.

It provides a very special advantage to increase the heat dissipation and thus to significantly reduce the temperature level within the communication system through the combination of heat sinks and surfaces for thermal connection.

To augment the heat dissipation, it is also advantageous if the top of the housing does not come into direct contact with the lower face of the body part, but rather if the air cushion that forms is used as additional insulation. In order to maintain this separation when mounting the housing beneath the body part, any spacer can be considered. These spacers can be separate components that are inserted between the body part and the housing during assembly. Advantageously, however, these spacers are either already on the lower face of the body part or on the corresponding upper side of the housing and fixed in position so that they can neither be lost nor shifted during assembly. The air cushion is present up to the region immediately beneath the cover on account of the necessary electrical connection (ground). In addition, tests have shown that this region is cooler than the roof panel outside the area of the cover, especially the outer cover (decorative cover). Therefore, a connection of the ground in exactly this and only this region is functional ideal, both electrically and thermally.

It is very especially advantageous if the housing has at least one spacer in a direction of support, preferably on both sides of the antenna support. The symmetrical arrangement of spacers on both sides of the antenna support ensures proper positioning of the housing relative to the body part and also that the required spacing between the housing and the body part is maintained. A rigid or elastically deformable adhesive pad can for example be considered in such a case/In addition or as an alternative, a magnet can also be used that hangs with the metal side onto a housing part, preferably the housing cover, and has foam on the upper face. If one housing part is not made of a magnetic material, the magnet can also be attached to the lower face of the body part, or it is attached, for example glued, to the housing part in question or to the lower face of the body part.

An adhesive pad can be affixed, on the one hand, to the surface of the housing or of the lower face of the body part. The other surface remains equipped with a protective cover that is removed only when the housing is mounted through removal of the antenna support together with the housing from below through an opening in the body part. These adhesive pads then not only maintain the desired spacing between the housing and the body part, but also fix the housing in its position relative to the body part. This fixation can be permanent, in which case no further attachment of the housing to the body part is required. In addition to the adhesive pad, however, other mounting options (such as locking, screwing, adhesive bonds, and the like) can be considered for the purpose of permanently fixing the housing with the antenna support in its desired position on the body part. The advantage of "adhesive pads" is that acceleration forces ("G forces") are absorbed at several points relative to the length of the housing. This minimizes leverage forces that can occur during acceleration. Instead of an adhesive pad, any other similarly acting spacers (such as magnets) can also be used.

In a development of the invention, the housing has an upper housing part made of a metallic material and a lower housing part made of a nonmetallic material. As a result, the housing is simple to manufacture, quick to assemble, and has the desired specific properties in order to either reduce heat input into the housing (for example, as a result of solar radiation above the body surface and the upper housing part) through heat radiation (use of materials with a low absorptivity) reduce and/or to dissipate heat from the inside of the housing via heat conduction and heat radiation (use of materials with a high absorptivity) to the outside via the lower housing part into cooler regions.

In a development of the invention, the lower nonmetallic housing part is partially provided with a metallic inlay (heat sink), in particular with a coating (anodizing) in order to improve thermal radiation. The required effects for heat dissipation can thus be adjusted in a targeted manner.

Examples of materials that can be used for the upper housing part are solid aluminum or a body made of plastic that is coated with aluminum. The lower housing part is also made of plastic that is coated in the appropriate places with copper or aluminum or has inlays of aluminum or copper, for example. These inlays can also have an electrical connection to the electronics within the housing so that they can be operated as antennas. Alternatively, the body of the lower housing part can be made of thermally conductive plastic.

In a development of the invention, the housing, particularly the upper housing part, carries at least one antenna element. For instance, a GPS patch or the like can be on and/or fastened to the upper housing part, thereby also providing a grounding surface directly by virtue of the metallic material.

In the following, the particularly advantageous mode of action of the communication system according to the invention for achieving optimized thermal management is summarized again. It is assumed that a housing with electronics is present that is beneath a body part of a vehicle, particularly a vehicle roof, and that a need exists to lower the temperature within the housing. To achieve this, two aspects are taken into account individually, preferably in combination:

1. Prevention of heat input as a result of solar thermal radiation:
   a) Insulation by a layer of air (that is present anyway) or an additional suitable insulating material between the body part of the vehicle and the housing, preferably the upper housing part (also called the housing cover).
   b) Thermal radiation emanates from the hot vehicle roof panel. In order to prevent the housing from absorbing the heat, the smallest possible absorptivity (equal to the emissivity) of the material of the housing (the upper part) is required. Aluminum above all, but without a coating, anodization, or the like in this case, thus merits particular consideration. It is therefore desirable for the material of the housing to reflect the thermal radiation so that no heat input occurs from the outside (generated above all by the sunlight on the vehicle roof) into the housing.

2. Dissipation of the heat in the interior of the housing to the outside. The following two mechanisms are used for this:
   a) Heat conduction. This means that the heat generated by the heat-generating electronic components is selectively transmitted to the lower part of the housing (supported by a heat-conducting gel) and into the surface via a heat sink associated with the component (heat spreading).

b) Heat dissipation/radiation into a region facing away from the body part area due to the high emissivity of the material of the housing or the heat sink including coating, particularly of the lower housing part. This only makes sense on the lower face of the housing, since there is adjacency here to the cooler passenger compartment, for example. At the top, the housing need not have a corresponding coating, since the hot roof plate (heated by solar radiation) is situated opposite here, so a low emissivity/absorptivity is required.

BRIEF DESCRIPTION OF THE DRAWING

Further embodiments of the invention from which similar advantages follow are described in the subclaims. These embodiments will be explained in greater detail below with reference to specific embodiments.

Insofar as shown in detail.

SPECIFIC DESCRIPTION OF THE INVENTION

Figure 1:
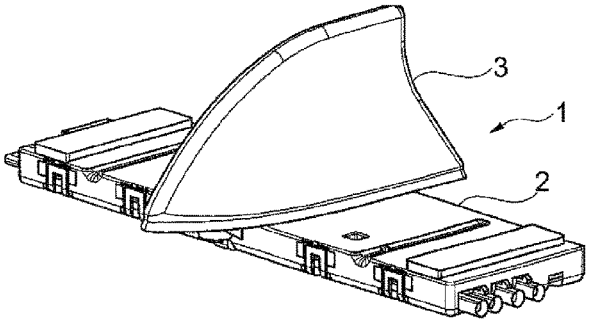
FIGS. 1 to 4 show the basic structure of a communication system 1 according to the invention.

According to FIG. 1, the communication system 1 consists of a housing 2 and, optionally, a decorative cover 3. What is not shown is a body part of a vehicle, in particular a vehicle roof, in on which the communication system 1 is mounted and attached. Although not shown, according to FIG. 1, the housing 2 is beneath the body part and the decorative cover 3, if present, is above the body part and fixed in their respective positions.

Figure 2:
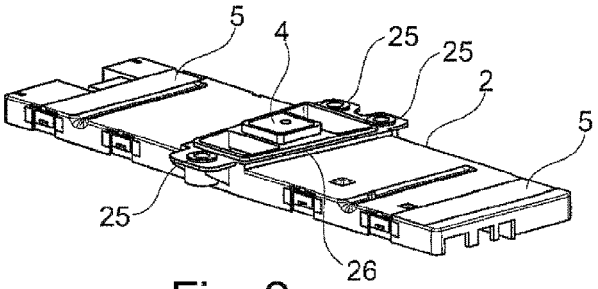

FIG. 2 shows the upper housing part 201 alone, it being possible but not necessary for a first antenna element 4, particularly a GPS patch or SAT services such as SDARS or the like, to be provided for example in the middle. In the illustrated embodiment according to FIG. 2, an attachment region around this antenna element 4 is shown that will be described later in connection with an antenna support according to the invention that is not yet shown here. Reference numeral 5 denotes contact surfaces for spacers of any kind, which will also be described.

Figure 3:
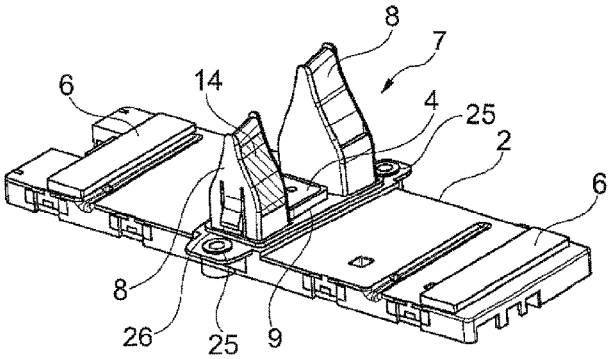

FIG. 3 shows additional elements of the communication system 1, namely for example adhesive pads 6 that have been adhered to the support surfaces 5. In this state of the housing 2, the adhesive pads 6 still have protective films on their upper faces that are then removed before the housing 2 is pressed from below against the lower face of the body part.

The antenna support 7 according to the invention is also shown in FIG. 3. In this embodiment, the antenna support 7 has two spaced-apart domes 8, with it also being possible for only a single dome or more than two domes 8 to be present. Likewise, the at least one dome is almost completely closed, but it can alternatively also have openings, a grid structure, or the like in order to ensure thorough movement of the air in the electronics box and under the decorative cover. In the embodiment according to FIG. 3, the optional antenna element 4 is between the two domes 8, with each of the domes 8 being passed through a recess 9 in the upper housing part 201. If no such antenna element 4 is present, the connecting bottom plate is embodied so as to be continuous without an opening, in which case it is also conceivable for recesses to be present in the same number in which antenna elements are provided in this intermediate region. Moreover, additional recesses, openings, and the like can be provided when other things are to be passed through this bottom plate connecting the two domes. Connectors, cables, or the like come to mind in this regard.

Figure 4:
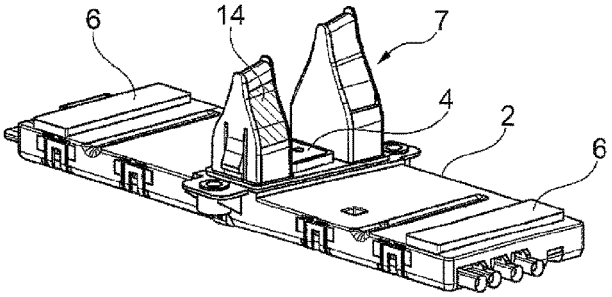

FIG. 4 shows the same assembled state of the housing 2 with the antenna support 7 and mounted circuit board and lower housing part.

Figure 5:
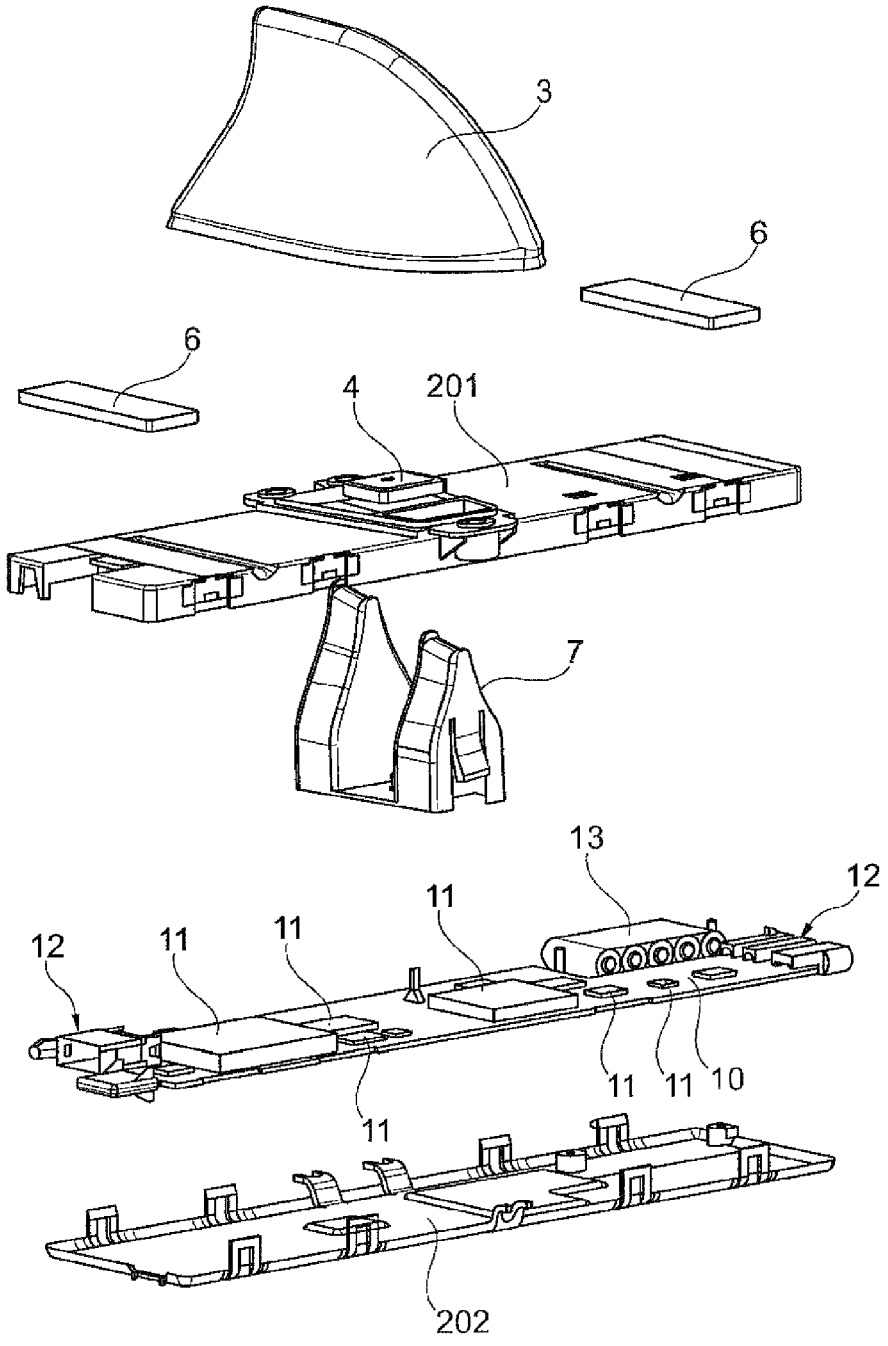
FIG. 5 shows an exploded view of this communication system 1.

FIG. 5 shows an exploded view of the communication system 1 that consists of several components. The housing 2 consists of two housing parts, namely an upper housing part 201 and a lower housing part 202. The upper housing part 201 is made of a material with a low absorptivity for thermal radiation coming through the body part in the installed state and should simultaneously have high heat conduction. Aluminum, preferably bare aluminum, is given especially preferable consideration here. The use of such an electrically conductive material for the upper housing part 201 also has the advantage that, in particular, the above-mentioned GPS patch or also a patch antenna for other satellite services and the like forms a metallic base, particularly a ground surface, for the antenna element 4.

Moreover, the lower housing part 202 is also made of an electrically conductive material such as aluminum but is preferably made of a thermally conductive plastic. A circuit board 10 is between these two housing parts 201, 202 that, when shown schematically, holds a plurality of electronic components 11. These electronic components 11 can be only on one side of the circuit board 10, or also on both sides of the circuit board 10. Connectors 12 are provided for the supplying power and/or signals and of outputting signals to and from the communication system 1. Moreover, a power supply 13 can but need not be integrated into the housing 2. As a rule, power is supplied via the connector 12 to the communication system 1 elsewhere, for example via the electrical system of the vehicle. However, if this power supply fails (in a collision, for example) but an emergency call needs to be placed, the power supply 13 acts as the power supply of the communication system 1.

The above-described adhesive pads 6 and the antenna support 7 are also shown. In addition, the optional decorative cover 3 and the optional antenna element 4 are shown.

Additional details regarding the design of the antenna elements that are on the antenna support 7 in accordance with the invention and the means for improving the thermal management of the communication system 1 are described in greater detail below in the following FIGS. 6 to 11 on the basis of the communication system 1 shown in FIGS. 1 to 5, optionally with specific modifications.

Figure 6:
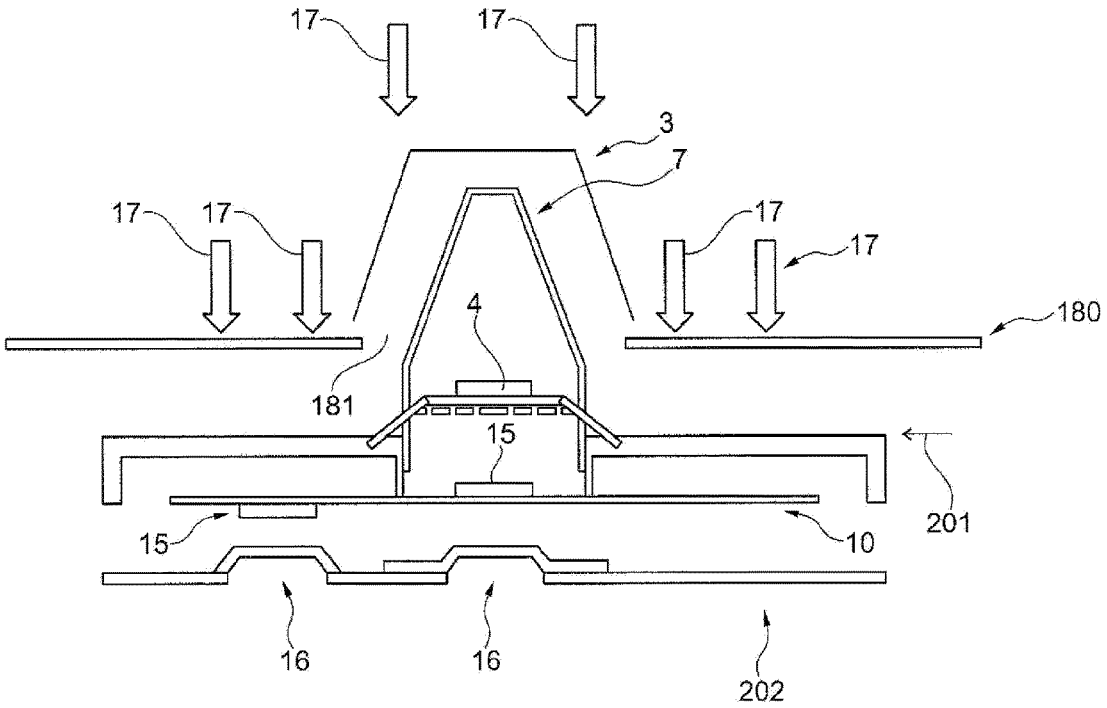
FIGS. 6 to 11 show various embodiments of such a communication system 1.

FIG. 6 shows a sectional view of a first embodiment based on the communication system 1 according to FIGS. 1 to 5. By way of example, heat sources 15, which are electronic components 11 in particular, are shown on each side of the circuit board 10. It is necessary during operation of the communication system 1 to dissipate the heat of these heat sources 15 to the outside, preferably by heat conduction or heat spreading. Provision is made for this purpose that the housing, particularly the associated housing part 201 and/or 202, has at least one heat sink with high thermal conductivity. A high emissivity for the heat radiation toward the region of the cooler passenger compartment is crucial here. Targeted heat dissipation of the heat generated by the heat sources 15 occurs via these heat sinks 16 that, for example, form a separate component or have a defined shape and/or are a coating on the respective housing part. This targeted dissipation of heat occurs either as a result of the fact that the heat is dissipated by the heat sink 16 to the outside and/or that the heat from the heat sink 16 is conducted to the surrounding area of the associated housing part and dispelled through it to the outside. The heat sink shown to the left as viewed in FIG. 6 is formed by the housing part 202 and provided with a for example anodized coating. The heat sink shown to the right as viewed in FIG. 6 is a separate component, for example an aluminum sheet (optionally with an anodized outer surface), having the illustrated shape and is in the vicinity of a recess in this housing part 202. It is important here that the respective heat sinks be in an area in which a heat source 15 is located. The surface areas of heat source 15 and heat sink 16 are either equal to or smaller or larger than each other, with equal area ratios or a surface area of heat sink 16 that is greater than the surface area of heat source 15 to ensure good heat dissipation.

In FIG. 6, reference 17 designates heat exposure, particularly solar radiation. This heat exposure 17 is transmitted via a body part 180, here the vehicle roof, into the underlying interior of the vehicle. It can be seen very clearly here that the upper housing part 201 is spaced below the lower face of the body part 180, with insulation created by this intervening air gap, so that no heat absorption at all or only slight additional heat absorption occurs as a result of the heat radiation via the material with a low absorptivity/emissivity.

The body part 180 has an opening 181 through which the antenna support 7, which is fastened to the housing 2, particularly the upper housing part 201, projects. geometric cross section of the antenna support 7 could be dimensioned on one side such that its outer peripheral surface is flush with and seals the border of the body opening 181. In such a case, it would not be necessary to mount the illustrated decorative cover 3. If the decorative cover 3 were not mounted, however, the antenna elements on the antenna support 7 (not shown here) would have to be also protected by a for example coating.

Figure 7:
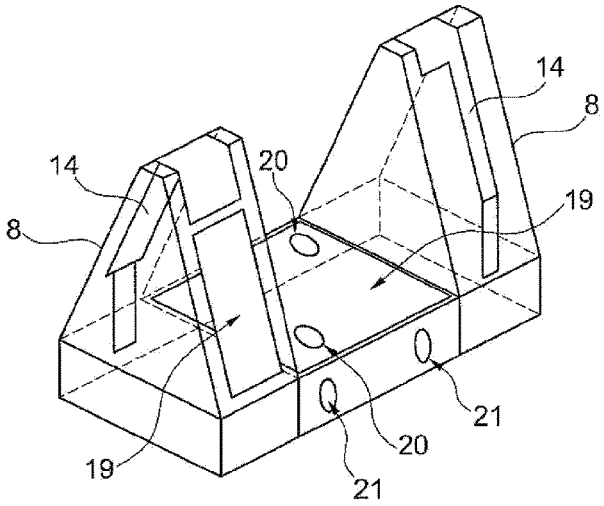

FIG. 7 shows a schematic embodiment of the antenna support 7. Again, this antenna support 7 has the two spaced-apart domes 8 on the surface of which are mounted the at least one antenna element 14, here a separate antenna element 14 on each dome 8. In addition, the antenna support 7 is provided with surfaces 19 for thermal connection. The surface shown on dome 8 to the left when viewing FIG. 7 is an area that is used for the thermal connection of the antenna support 7 to the decorative cover 3, if present. The surface 19 for thermal connection between the two domes 8 is used for thermal connection and thus for heat transfer from the interior of the housing 2 to the outside or to other elements.

Reference 20 denotes at least one feedthrough hole that can be used, for example, to pass an antenna element that is arranged with its antenna base point on the circuit board 10 with its geometric extension to the outside. In addition or as an alternative, cables, plug connectors, or the like can be passed through these feedthroughs 20. The converse embodiment is also conceivable in which the antenna is mounted on the housing through the housing cover and then fixed to the circuit board at the antenna base.

Reference 21 denotes fastening formations that are shown schematically and with which the antenna support 7 can be arranged and fixed to the housing 2. Alternatively, the antenna support 7 can also be glued, caulked, riveted, welded, or otherwise fixed to the housing 2. This means that the antenna support 7 is either detachably or non-detachably connected to the housing (in the latter case, only detachable by damage or destruction).

Figure 8:
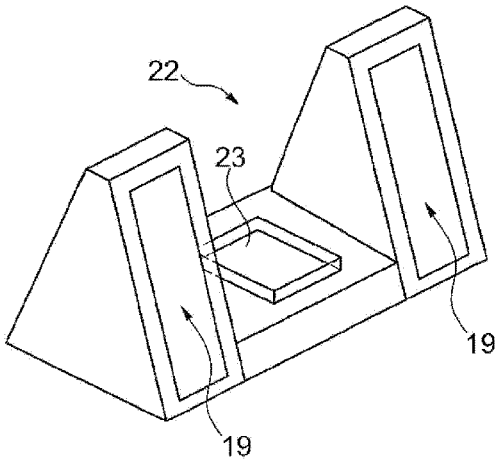

As a second element, FIG. 8 shows a protective cover 22 that corresponds roughly in shape to the shape of the antenna support 7. This optional protective cover 22 can be slipped over the antenna support 7 and fixed in its position, particularly in order to protect the antenna elements 14, but also the surfaces 19 for thermal connection, from external influences. If the antenna element 4 is located between the two domes 8 of the antenna support 7, the protective cover 22 can have a corresponding recess 23. Regardless of whether the antenna element 4 is present or not, the protective cover 22 can have at least one or more recesses 23 through which cables, connectors, or the like can be fed to the outside. In particular, such a recess 23 is present when an antenna element is on the circuit board 10 and is fed out of the housing 2 into the region between the two domes 8 and thus the region between the two covers of the protective cover 22 for these two domes 8. Insofar as there is a protective cover 22, it can also have surfaces 19 for thermal connection. In an especially advantageous manner, these surfaces 19 of the protective cover 22 cover at least the surfaces 19 on the domes 8 (covering). This effectively ensures that, when the protective cover is present and beneath the decorative cover 3 (insofar as it is present), effective heat transfer occurs from the interior of the housing 2 and from the interior of the antenna support 7 to the outside.

Figure 9:
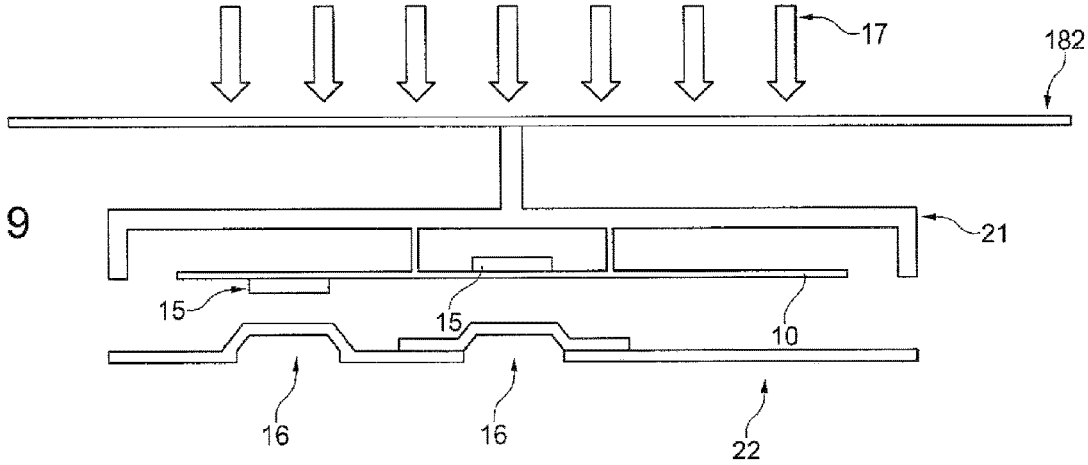

FIG. 9 shows that an electrically conductive body part 182 is provided that, however, has no opening. Here, too, the designs and advantages of the housing 2 according to the invention can be realized by attenuating in particular the heat exposure 17 by the spacing between the surface of the housing part 201 and the lower face of the body part 182. In addition, as was already described, the heat input of the heat sources 15, particularly of the electronic components 11, can be selectively reduced by means of the heat sinks 16.

Figure 10:
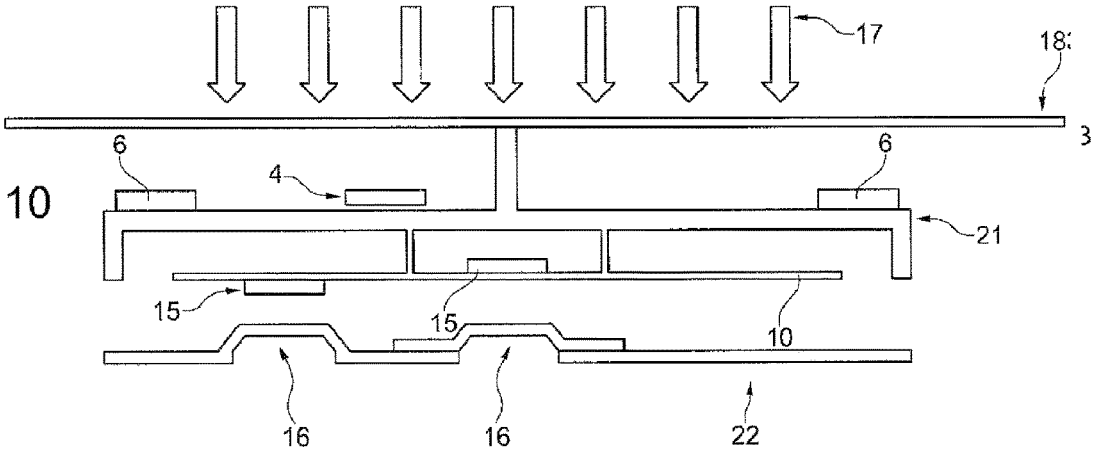

FIG. 10 shows a similar embodiment in which a body part 183 is shown without opening, with this body part 183 being electrically nonconductive, however. This makes it permeable to high-frequency radiation, so that at least one antenna element (the antenna element 4 from the preceding figures is shown here) is on the upper side of the upper housing part 201.

Figure 11:
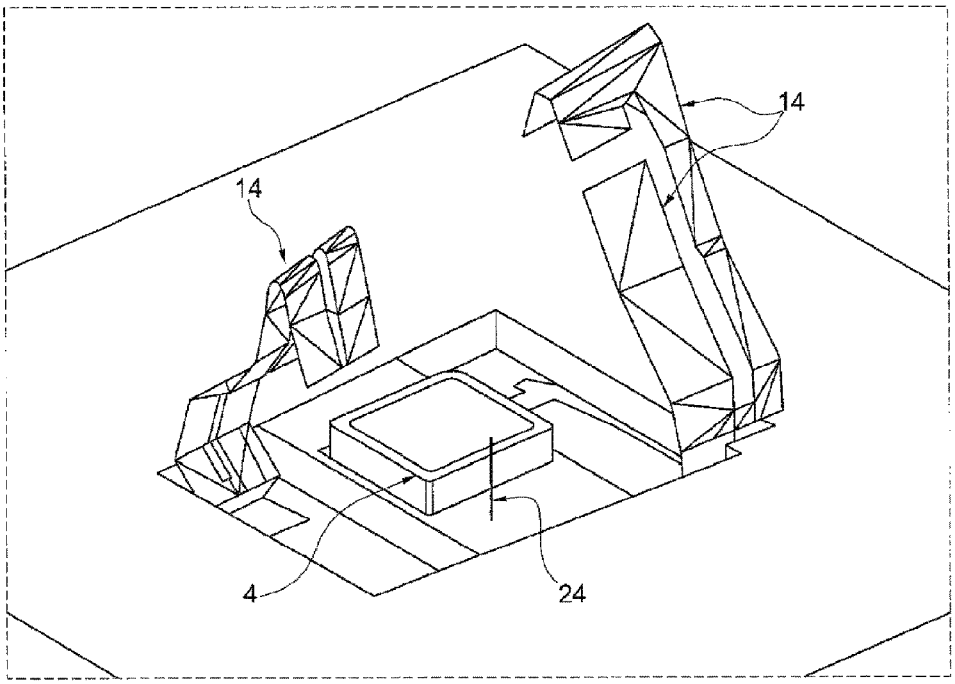

Finally, FIG. 11 shows an example of the fact that the antenna support 7, not shown here, can have on its surface a plurality of antenna elements of identical or different appearance. An antenna element (shown to the left in FIG. 11), which is designed for a mobile network, for example, is provided on one of the domes of the antenna support (not shown). The antenna element 14 shown to the right when viewing FIG. 11 is also an antenna element for a mobile service. The so-called MIMO principle, in which multiple transmitting and receiving antennas are used simultaneously for one service, is essential, for example. Moreover, the optional antenna element 4 is shown that is located between the two domes 8 of the antenna support 7 (not shown). This antenna element 4, if present, is on the upper side of the upper housing part 201, for which purpose this housing part 201 has an elevation in the area in which the antenna element 4 is to be located (see FIG. 6, for example).

In addition, another antenna element 24 is shown that for example can be a V2-X antenna, for example. This approximately rod-shaped antenna element 24 extends from the circuit board 10 through one of the passages 20 in the antenna support 7 and, if present, through a corresponding passage in the protective cover 2 into the free area between the two domes 8 of the antenna support 7.

Particularly in looking at FIG. 11, it can be seen that the antenna elements 14 have a planar design and, as shown in FIGS. 3 and 4, are on the surface of the antenna support 7, particularly on the domes 8 thereof. These planar antenna elements 14 are metal foils, for example, that can be arranged, for example glued, printed, sprayed on, or the like, on the surface of the antenna support 7. They can be guided by an extension of the metal foil, by connectors, by cables, by crimp contacts, or by a spring contact system, or the like, toward the point of connection on the circuit board 10, so that they are contacted with the associated electronic components 11 and the high-frequency signals received via the antenna elements 14 can be further processed by the electronic components 11. Alternatively or in addition, the reverse transmission path is also possible, namely where high-frequency signals are emitted by the associated electronic components 11 via the antenna elements 14.

It is generally important for the functioning of the communication system 11 illustrated and described herein that, if the body part is made of an electrically conductive material, the upper housing part 201 is connected to the body part for the purpose of EMC shielding. However, this connection between the housing part 201 and the associated body part for the purpose of making electrical contact must be made very small in order to ensure the previously described advantageous spacing between the upper housing part and the body part and also to minimize the contact surface of the heat conduction.

The at least one antenna element can also be embodied in the usual form as an antenna rod.

With reference to FIGS. 2 and 3, it is also important to point out that not only in this embodiment, but also in other implementations of the communication system, the housing 2, particularly the upper housing part 201, has at least one fastening element 25 and/or at least one partially, preferably completely encircling edge 26. In the embodiment according to FIGS. 2 and 3, the at least one fastening element 25 is arranged so as to project from the side edge of the housing 2 and comprises a through hole for a fastening formation, for example a screw. The fastening formations fix the housing 2 at a suitable location on the body part. The fastening formations can come into operative connection with the body part, for example, but also with a dome, particularly the decorative cover. In this embodiment, a fastening element 25 is provided on one longitudinal side of the housing 2, with two fastening elements 25 being provided on the opposite longitudinal side. This embodiment is exemplary, so that at least one fastening element 25 can be provided on each longitudinal side, optionally on the front side as well. The distinctive feature of the illustrated fasteners 25 is the fact that a kind of tab projects from the housing 2, this tab being arranged with reinforcing ribs on the longitudinal side of the housing 2. In addition to the at least one reinforcing rib, a through hole is provided through which the screw can be passed, for example. In looking at FIGS. 2 and 3, it is clear that a raised area is provided above the protruding tab around the through hole. By means of this raised area, the housing 2 is brought to rest flatly against the lower face of the body part, while the remaining surface of the housing 2 is spaced slightly apart from the lower face of the body part. This spacing is a result of the height of the peripheral border of the protruding tab around the fastening formations 25 and corresponds approximately to the height of the adhesive pad 6. In addition or as an alternative, the top of the housing 2 is provided with an at least partially, preferably fully peripheral edge 26. With regard to the height of the peripheral edge, exactly the same applies to the peripheral edge in the region of the fastening formations 25. This configuration of the peripheral edge in the vicinity of the fastening formations 25 and/or the peripheral edge 26 exploits the fact that it is even cooler in this region, particularly in the region approximately beneath the peripheral edge of the decorative cover 3, than in the region outside peripheral border 26 (or the peripheral border of the decorative cover 3), so that this connection of the housing 2, particularly the upper housing part 201, is ideal for heat dissipation.

The invention claimed is:

1. A communication system, comprising:

a housing that has a metallic upper part with a predetermined absorptivity and a nonmetallic lower part with a absorptivity higher than that of the upper part;

a circuit board with electronic components in the housing between the parts;

an antenna element outside the housing; and an antenna support outside the housing, having two separate spaced-apart domes, and connectable to the housing, the antenna element on the surface of and/or within the antenna support.

2. The communication system according to claim 1, wherein one of the parts has a heat sink with high thermal conductivity.

3. The communication system according to claim 2, wherein the heat sink is formed by the part.

4. The communication system according to claim 2, wherein the heat sink is a separate component and on the part.

5. The communication system according to claim 1, further comprising:

a decorative cover connected to the antenna support can be connected.

6. The communication system according to claim 5, wherein the antenna support has surfaces for thermal connection to the decorative cover and/or the housing.

7. The communication system according to claim 5, further comprising:

a protective cover for the antenna element on the surface of the antenna support between the decorative cover and the antenna support.

8. The communication system according to claim 7, wherein the protective cover has a surface turned toward the antenna support and/or toward the decorative cover for thermal connection to the surface of the antenna support and/or the inside of the decorative cover.

9. The communication system according to claim 1, wherein the housing has a spacer in a direction of support on a side of the antenna support.

10. The communication system according to claim 1, wherein the lower nonmetallic part is partially provided with a metallic coating or has a metallic inlay.

11. The communication system according to claim 1, wherein the upper part carries the antenna element.

12. The communication system according to claim 1, wherein the upper part has a fastening element for securing the housing to a roof of a motor vehicle with the upper part above the roof and the lower part beneath the roof.

13. The communication system according to claim 1, wherein the upper part has an at least partially encircling outer peripheral edge.

14. A communication system, comprising:

a housing that has a metallic upper part with a predetermined absorptivity and a nonmetallic lower part with a absorptivity higher than that of the upper part;

a circuit board with electronic components in the housing between the parts;

an antenna element outside the housing; and a functional element support having two separate domes, connectable to the housing, and having thermal conductivity properties.

* * * * *